US010775142B1

(12) United States Patent
Pineda

(10) Patent No.: US 10,775,142 B1
(45) Date of Patent: Sep. 15, 2020

(54) PAINTBALL POD HARNESS

(71) Applicant: HK Army Inc., Gardena, CA (US)

(72) Inventor: Jason Jeremiah Pineda, Gardena, CA (US)

(73) Assignee: HK Army Inc., Gardena, CA (US)

( * ) Notice: Subject to any disclaimer, the term of this patent is extended or adjusted under 35 U.S.C. 154(b) by 0 days.

(21) Appl. No.: 16/850,286

(22) Filed: Apr. 16, 2020

(51) Int. Cl.
*A45F 5/02* (2006.01)
*F42B 39/02* (2006.01)

(52) U.S. Cl.
CPC ..... *F42B 39/02* (2013.01); *A45F 5/021* (2013.01)

(58) Field of Classification Search
CPC ..... A45F 5/021; A45F 2003/144; Y10S 224/904; Y10T 24/1388
See application file for complete search history.

(56) References Cited

U.S. PATENT DOCUMENTS 4,029,243 A * 6/1977 Zerobnick ..... A45F 3/00 224/681
4,384,372 A * 5/1983 Rector ..... A41F 9/002 2/300
4,569,465 A * 2/1986 O'Farrell ..... A45C 1/04 224/251
D290,549 S * 6/1987 Smith ..... D3/221
4,747,527 A * 5/1988 Trumpower, II ..... A41F 9/002 2/311
4,819,846 A * 4/1989 Hannemann ..... A45F 5/00 2/312
5,086,759 A * 2/1992 Buddingh ..... A61F 5/028 128/101.1
D335,025 S * 4/1993 Thomas ..... D3/230
D338,340 S * 8/1993 Burks ..... D3/230
5,240,156 A * 8/1993 Sicotte ..... A41F 9/002 224/148.5
5,255,835 A * 10/1993 Burks ..... A45C 1/04 150/112
5,353,975 A * 10/1994 Libertucci ..... A45C 1/04 224/662

(Continued)

*Primary Examiner* — Brian D Nash
(74) *Attorney, Agent, or Firm* — Knobbe, Martens, Olson & Bear, LLP

(57) ABSTRACT

A paintball harness has a support plate with a rear surface that faces toward a user's lower back when the harness is worn by the user. A pair of primary straps extend from opposite ends of the back plate and can extend about the user's waist and removably couple to each other when the harness is worn by the user. The harness has a pair of secondary straps attached to the rear surface of the support plate and extend through a pair of openings in the support plate. At least a portion of the pair of secondary straps are elastic, the pair of secondary straps configured to releasably couple to a front surface of the pair of primary straps. A plurality of holsters attach to the support plate, each holster defining a channel that resiliently receives at least a portion of a pod of paintballs therein. The pair of secondary straps can be stretched while detached from the pair of primary straps to adjust a tension of the harness on the user and can be coupled pair of primary straps in the stretched position, where increasing the stretching of the secondary straps further pulls the support plate against the user's back when the harness is worn by the user.

19 Claims, 11 Drawing Sheets

(56) References Cited

U.S. PATENT DOCUMENTS 5,375,749 A * 12/1994 Oliva ..... A45F 5/02 224/242
5,464,136 A * 11/1995 Eddy ..... A45F 5/021 224/666
5,470,000 A * 11/1995 Munoz ..... A45F 5/02 2/300
5,511,703 A * 4/1996 Ryerson ..... B25H 3/00 224/682
5,551,085 A * 9/1996 Leighton ..... A61F 5/028 2/44
5,570,824 A * 11/1996 Lyon ..... A45F 3/00 224/240
5,693,006 A * 12/1997 Slautterback ..... A61F 5/028 602/19
6,398,092 B1 * 6/2002 Ansley ..... A45F 5/02 224/582
6,698,636 B2 * 3/2004 Angus ..... A45F 3/00 224/660
6,766,532 B1 * 7/2004 Cabana ..... A61F 5/026 2/310
6,913,176 B1 * 7/2005 Buscemi ..... A45F 5/00 224/665
7,699,197 B2 * 4/2010 Panosian ..... A45F 5/02 224/271
8,708,583 B2 * 4/2014 Chamberlayne ..... F16M 11/105 396/423
9,084,906 B2 * 7/2015 Schurian ..... A62B 35/0031
D771,939 S * 11/2016 Kinskey ..... D3/228
10,165,851 B1 * 1/2019 Downs ..... A45F 5/021
10,631,621 B2 * 4/2020 Gregory ..... A44B 18/0073
2006/0011687 A1 * 1/2006 Wadley ..... A45F 3/00 224/587
2014/0124559 A1 * 5/2014 Pomerantz ..... A45F 3/14 224/582
2015/0014382 A1 * 1/2015 Hintze ..... B25H 3/00 224/661

* cited by examiner

PAINTBALL POD HARNESS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field

The present invention is directed to paintball pod harness, and more particularly to a modular paintball pod harness with removable pod holders and double lumbar straps.

Description of the Related Art

Paintball is a popular team sport in which competitors shoot paintballs at each other using a paintball marker or gun, while players move over a field of play (e.g., a wooded or natural environment). Paintballs are loaded into a hopper attached to the marker, such that the hopper feeds paintballs into the marker during use. It is often necessary to reload the hopper with paintballs during a competition, and players usually carry a harness around their waist with pods housing paintballs, allowing them to refill the hopper with paintballs by removing a pod from the harness and engaging it with the hopper to transfer the paintballs from the pod to the hopper.

SUMMARY

In accordance with on aspect of the invention, an improved paintball pod harness is provided that allows for adjustment in tension of a belt of the harness, providing improved lumbar support during use and inhibiting (e.g., preventing) shifting, bouncing or movement of the harness on the player's back during use. Such inhibiting (e.g., preventing) of shifting, bouncing or movement of the harness on the player's body during use can reduce noise generated by such movement of the harness, and therefore facilitating the player's ability to move through a field of play without being heard (e.g., move surreptitiously).

In one implementation, the paintball pod harness has a main belt with a pair of primary straps attached to a backplate of the harness, the primary straps coupleable to each other to couple the harness about the player's waist. The harness also has a secondary belt with a pair of secondary straps attached to the backplate of the harness, the secondary straps configured to extend through openings in the harness (e.g., the backplate of the harness) and to removably couple to an outer surface of the primary straps. The secondary straps are elastic and configured to be stretched relative to the primary straps to tighten the backplate onto the player's back.

In accordance with another aspect of the invention, an improved paintball pod harness is provided with removable paintball pod holders, each holder removably coupleable to a backplate of the harness, and adjustable to adjust a tension provided by the pod holder to the pod that is inserted in it.

In accordance with one aspect of the disclosure, a paintball pod harness is provided. The harness comprises a support plate having a rear surface configured to face a user's lower back when the harness is worn by the user. The harness also comprises a pair of primary straps extending from opposite ends of the back plate and configured to extend about the user's waist and removably couple to each other when the harness is worn by the user. The harness also comprises a pair of secondary straps attached to the rear surface of the support plate and configured to extend through a pair of openings in the support plate. At least a portion of the pair of secondary straps are elastic, the pair of secondary straps configured to releasably couple to a front surface of the pair of primary straps. A plurality of holsters is attached to the support plate, the holsters defining a channel extending from an opening configured to resiliently receive at least a portion of a pod of paintballs therein. The pair of secondary straps are configured to be stretched while detached from the pair of primary straps to adjust a tension of the harness on the user and configured to be coupled pair of primary straps in the stretched position. Increasing the stretching of the secondary straps is configured to further pull the support plate against the user's back when the harness is worn by the user.

In accordance with another aspect of the disclosure, a paintball pod harness is provided. The harness comprises a support plate having a rear surface configured to face a user's lower back when the harness is worn by the user. The harness also comprises a pair of primary straps extending from opposite ends of the back plate and configured to extend about the user's waist and removably couple to each other when the harness is worn by the user. The harness also comprises a pair of secondary straps attached to the rear surface of the support plate and configured to extend through a pair of openings in the support plate. At least a portion of the pair of secondary straps is elastic, the pair of secondary straps configured to releasably couple to a front surface of the pair of primary straps. The harness also comprises a plurality of holsters removably attached to the support plate, the holsters defining a channel configured to resiliently receive at least a portion of a pod of paintballs therein. The pair of secondary straps are configured to be stretched while detached from the pair of primary straps to adjust a tension of the harness on the user and configured to be coupled pair of primary straps in the stretched position. Increasing the stretching of the secondary straps is configured to further pull the support plate against the user's back when the harness is worn by the user.

In accordance with another aspect of the disclosure, a paintball pod harness is provided. The harness comprises a support plate having a rear surface configured to face a user's lower back when the harness is worn by the user. The harness also comprises a pair of straps extending from opposite ends of the back plate and configured to extend about the user's waist and removably couple to each other when the harness is worn by the user. The harness also comprises a plurality of holsters removably attached to the support plate, the holsters defining a channel configured to resiliently receive at least a portion of a pod of paintballs therein. A tension provided by each of the plurality of holsters is adjustable by detaching the first and second elastic material portions from each other and reattaching the first and second material portions to each other so that their fasteners overlap relative to each other by a different amount.

DETAILED DESCRIPTION

Figure 1:
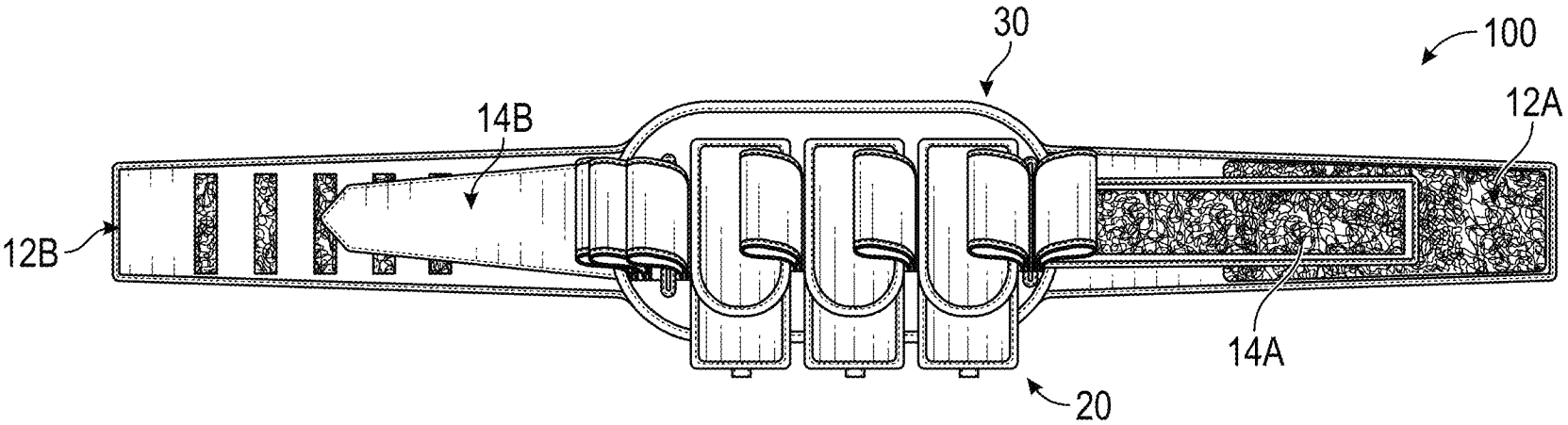
FIG. 1 is a top view of a paintball pod harness.
Figure 2:
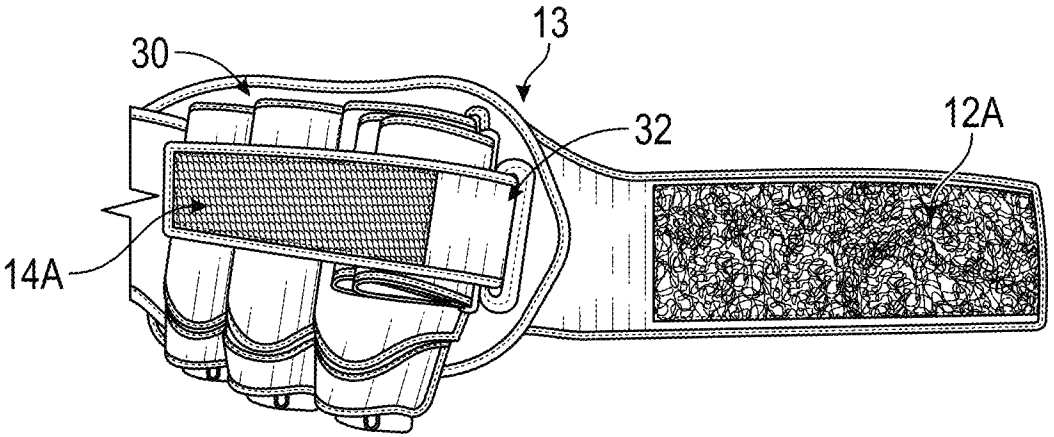
FIG. 2 is a partial view of the paintball pod harness of FIG. 1.
Figure 3:
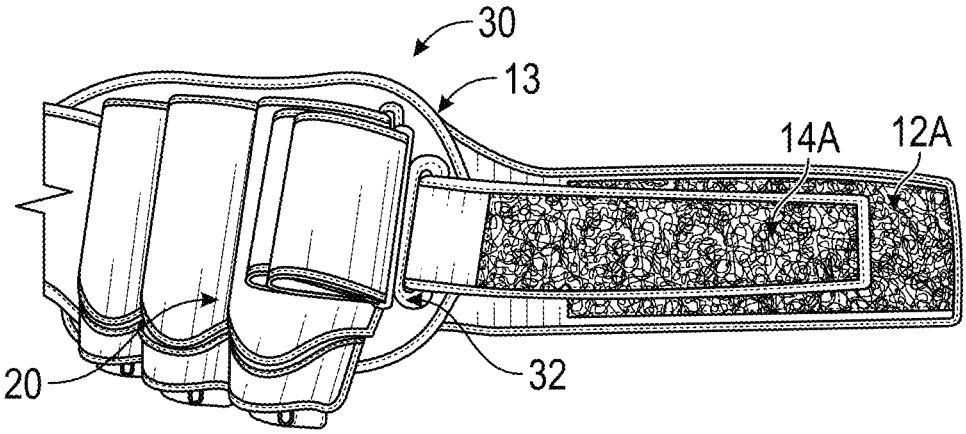
FIG. 3 is a partial view of the paintball pod harness of FIG. 1.
Figure 4:
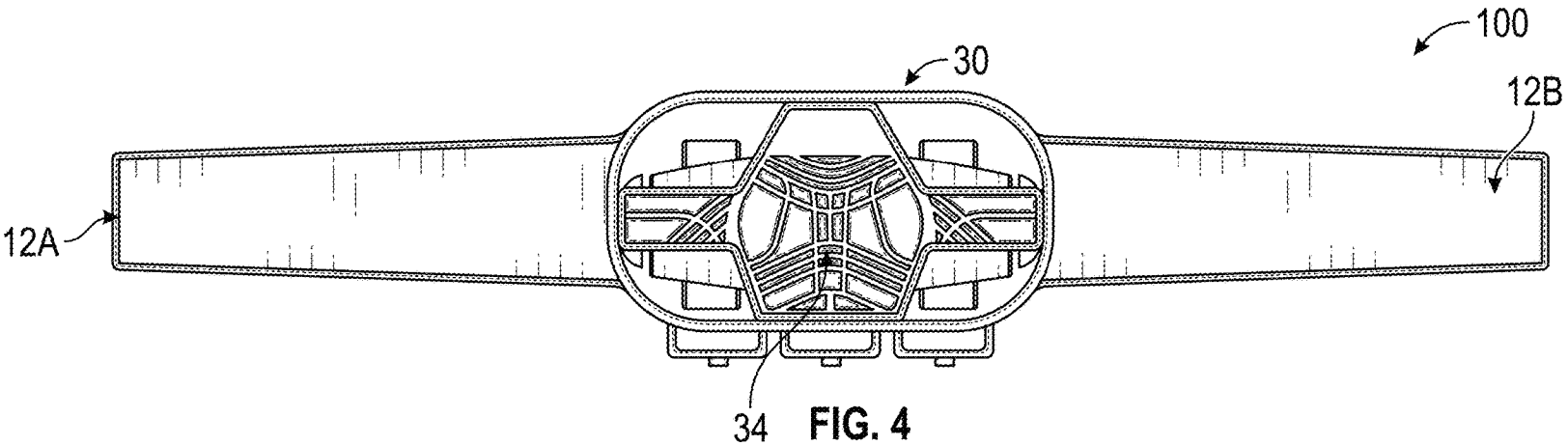
FIG. 4 is a bottom view of the paintball pod harness of FIG. 1 in an assembled state.
Figure 5:
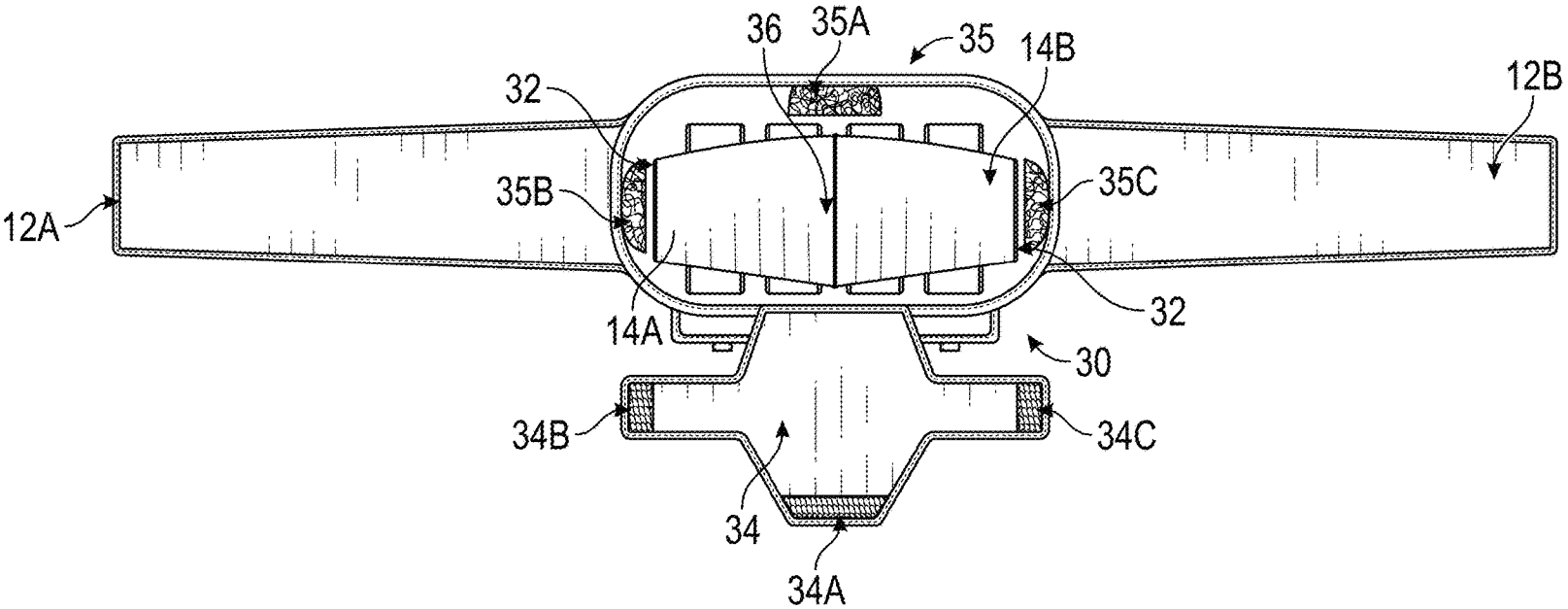
FIG. 5 is a bottom view of the paintball pod harness of FIG. 1 in a partially unassembled state.
Figure 6:
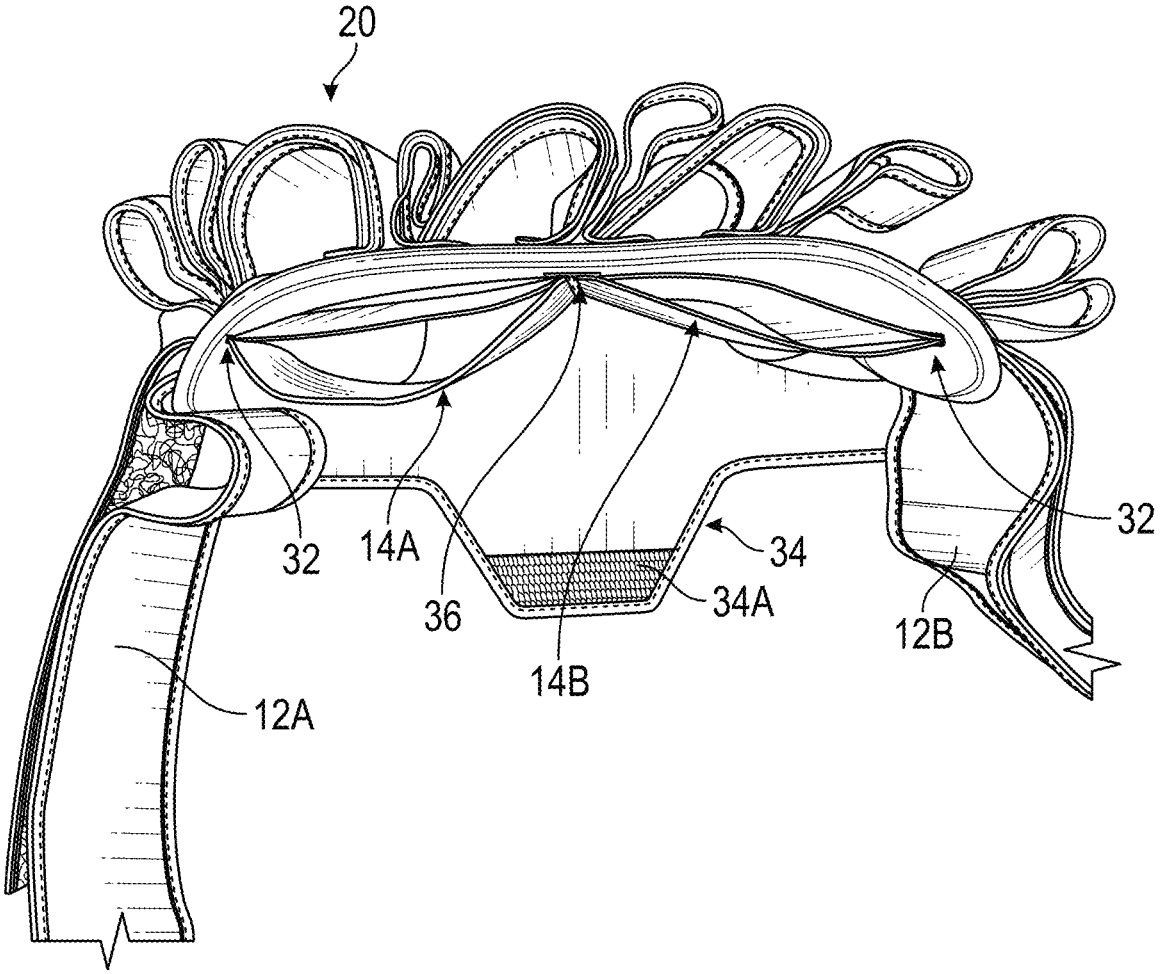
FIG. 6 is a top view of the paintball pod harness of FIG. 1 in a partially unassembled state.

FIGS. 1-7 show a harness (e.g., a paintball pod harness) 100 that can be work by a user about their waist, as further discussed below. FIGS. 8-11 show a holster 20 that can be used with the harness 100 and can removably receive at least a portion of a pod of paintballs. FIGS. 12-19 show the harness 100 during use. As used herein, the "front" side is intended to mean the side facing away from the user's body when the harness is wrapped around the user's waist. Similarly, the "rear" side is intended to mean the side facing toward the user's body when the harness is wrapped around the user's waist.

The harness 100 has a support plate (e.g., a back plate) 30 with one or more (e.g., a plurality, multiple) holsters 20, each sized to at least partially receive pod of paintballs. In one implementation, as further discussed below, the one or more holsters 20 are removable and adjustable relative to the back plate 30.

A pair of primary straps 12A, 12B attach (e.g., are sewn) to opposite ends (e.g., left portion, right portion) of the back plate 30 (e.g., via a seam 13). The pair of primary straps 12A, 12B define a main belt portion of the harness 100 that can be wrapped around the user's waist to attach the harness 100 to the user by attaching the primary straps 12A, 12B to each other so that a rear surface of the primary straps 12A, 12B face the user's body. In one implementation, the primary straps 12A, 12B releasably attach to each other with hoop-and-loop fasteners, such as VELCRO®. However, other coupling mechanisms (e.g., belt and belt-buckle) can be used to releasably attach the primary straps 12A, 12B together. In one implementation, at least a portion of each of the primary straps 12A, 12B is elastic (e.g., can resiliently stretch). For example, the primary straps 12A, 12B have a portion made of a stretchable material (e.g. a 2-way stretch material), such as elastane, Spandex or Lycra. Other suitable stretchable materials can be used.

The harness 100 has a pair of secondary straps 14A, 14B attached (e.g., sewn) to a rear surface of the back plate 30 (e.g., via a seam 36). In one implementation, the pair of secondary straps 14A, 14B are attached (e.g., sewn) approximately along a center axis of the back plate 30. The secondary straps 14A, 14B, can extend (e.g., movably or slidably pass) through openings 32 in the back plate 30 onto a front side of the primary straps 12A, 12B. The secondary straps 14A, 14B can releasably attach (e.g., with hoop-and-loop fasteners, such as VELCRO®) to a front surface of the primary straps 12A, 12B.

In one implementation, at least a portion of each of the secondary straps 14A, 14B is elastic (e.g., can resiliently stretch). In one implementation, the secondary straps 14A, 14B are more elastic (e.g., can stretch more) than the primary straps 12A, 12B. In another implementation, the secondary straps 14A, 14B are less elastic than the primary straps 12A, 12B. In another implementation, the secondary straps 14A, 14B are approximately as elastic as the primary straps 12A, 12B. For example, the secondary straps 14A, 14B have a portion made of a stretchable material (e.g. a 2-way stretch material), such as elastane, Spandex or Lycra. Other suitable stretchable materials can be used. The secondary straps 14A, 14B advantageously allow a user to adjust the tension of the harness 100 on the user's body. For example, the user can pull on the secondary straps 14A, 14B, as further discussed below, and attach the stretched secondary straps 14A, 14B to the primary straps 12A, 12B to thereby bring the back plate 30 (e.g. a rear surface of the back plate 30) closer to the user's body. The user can adjust the level of tension via the amount the secondary straps 14A, 14B are stretched before they are attached to the primary straps 12A, 12B.

With reference to FIGS. 4-7, the back plate 30 has a movable flap 34 releasably coupleable to a rear surface of the back plate 30 via fasteners 34A, 34B, 34C (e.g., hoop-and-loop fasteners, such as VELCRO®) on the flap 34 and corresponding fasteners 35 (e.g., hoop-and-loop fasteners 35A, 35B, 35C, such as VELCRO®). However, other suitable fasteners (e.g., snaps) can be used to couple the flap 34 to the back plate 30. The flap 34 can be padded and, once coupled to the rear surface of the back plate 30, can provide a padded lumbar support for the user's lower back when the harness 100 is wrapped around the user's waist. The flap 34, when attached to the rear surface of the back plate 30, can cover the secondary straps 14A, 14B.

Figure 7:
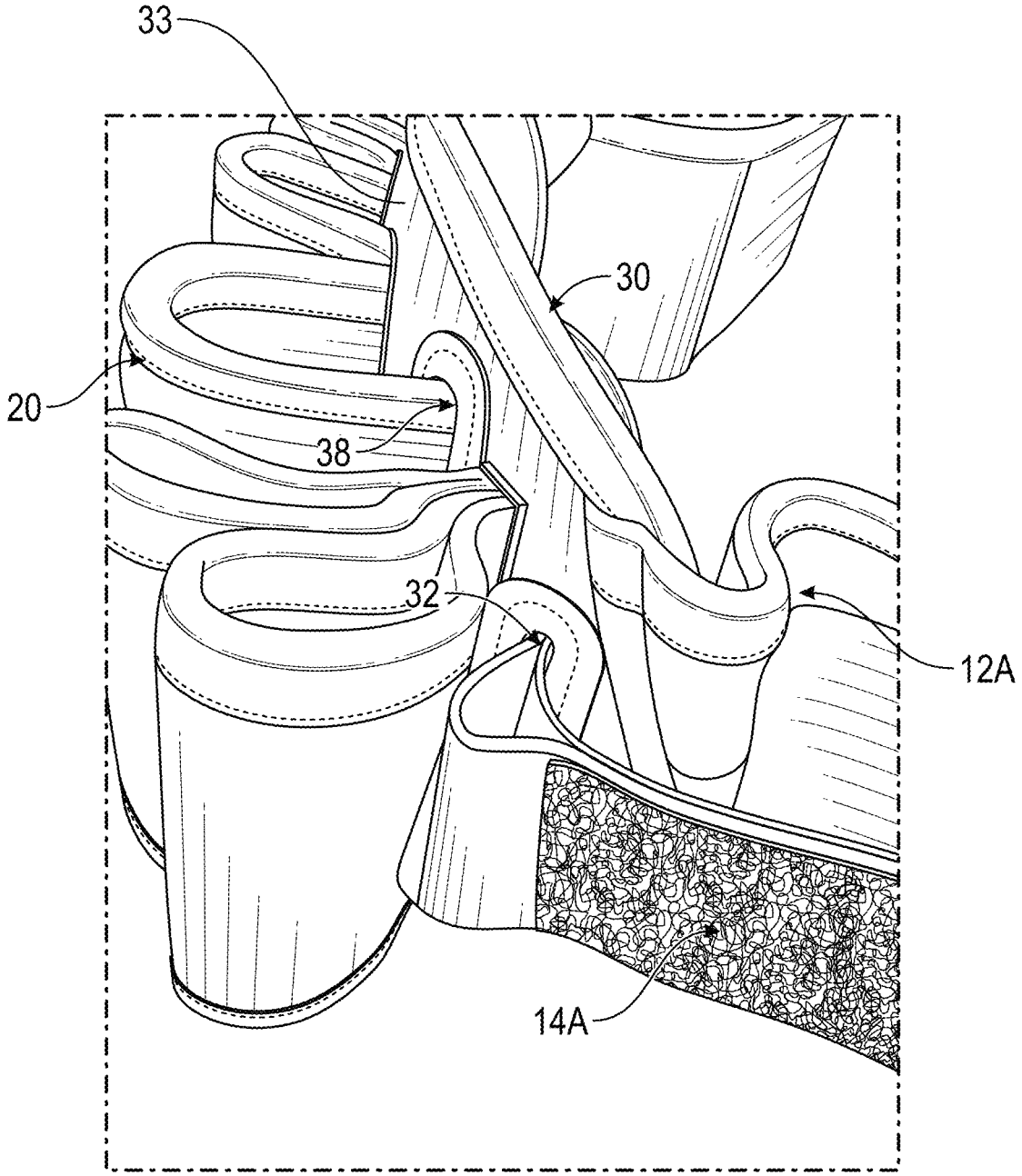
FIG. 7 is a partial side view of the paintball pod harness of FIG. 1.

Detaching the flap 34 from the rear surface of the back plate 30 allows access to the location of the back plate 30 that each holster 20 attaches to, as further discussed below. As shown in FIG. 7, sides of the holster 20 can extend through openings or slots 38 formed on a wall 33 of the back plate 30. The slots or openings 38 extend through the wall 33 of the back plate 30 and can be accessed from the rear surface of the back plate 30 (e.g., by detaching the flap 34 from the rear surface of the back plate 30). As shown in FIG. 7, the holster 20, once attached to the back plate 30, defines a channel that extends to an opening (e.g., facing upward) via which at least a portion of the pod of paintballs can be inserted into the holster 20.

FIGS. 8-11 show one implementation of the holster 20. The holster 20 has a stabilizing plate 26 on a front side of the holster 20 and elastic material portions 25 are attached (e.g., sewn) to left and right sides of the stabilizing plate 26. In one implementation, the elastic material does not extend behind the stabilizing plate 26 and only attaches to the left and right sides of the stabilizing plate 26. A backing (e.g. a padded backing) 27 is attached (e.g., sewn) to a rear surface of the stabilizing plate 26 and can engage a surface of the pod of paintballs when inserted in the holster 20. The backing 27 can in one implementation be smooth. In another implementation, the backing 27 can details (e.g., embossed details, printed details) that inhibit (e.g. prevent) slipping of the pod of paintballs in the holster 20. Accordingly, the backing 27 can facilitate the pod of paintballs to be securely held or retained in the holster 20.

Figure 8:
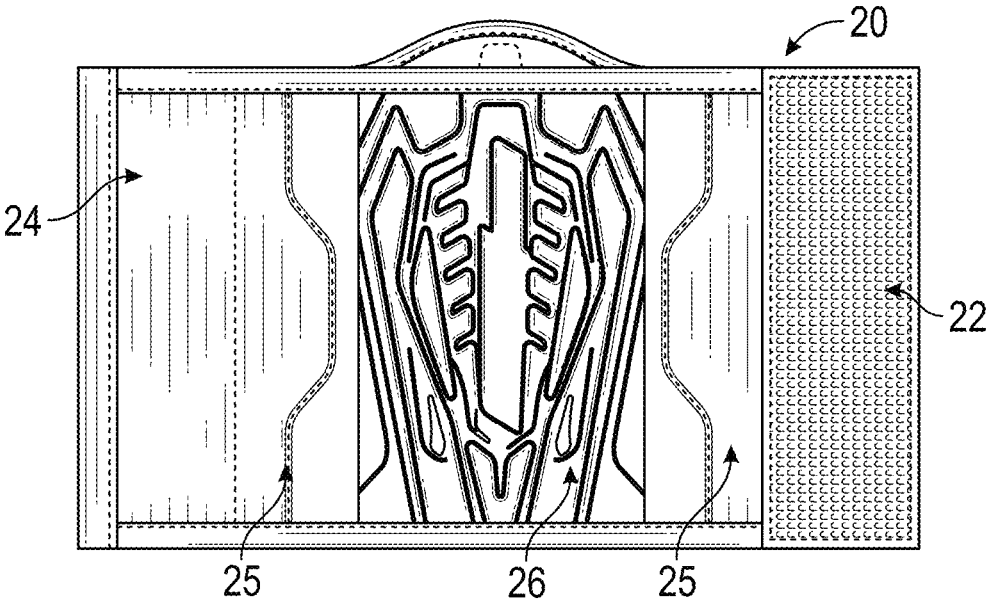
FIG. 8 is a front view of a pod holder for use with the paintball pod harness of FIG. 1
Figure 9:
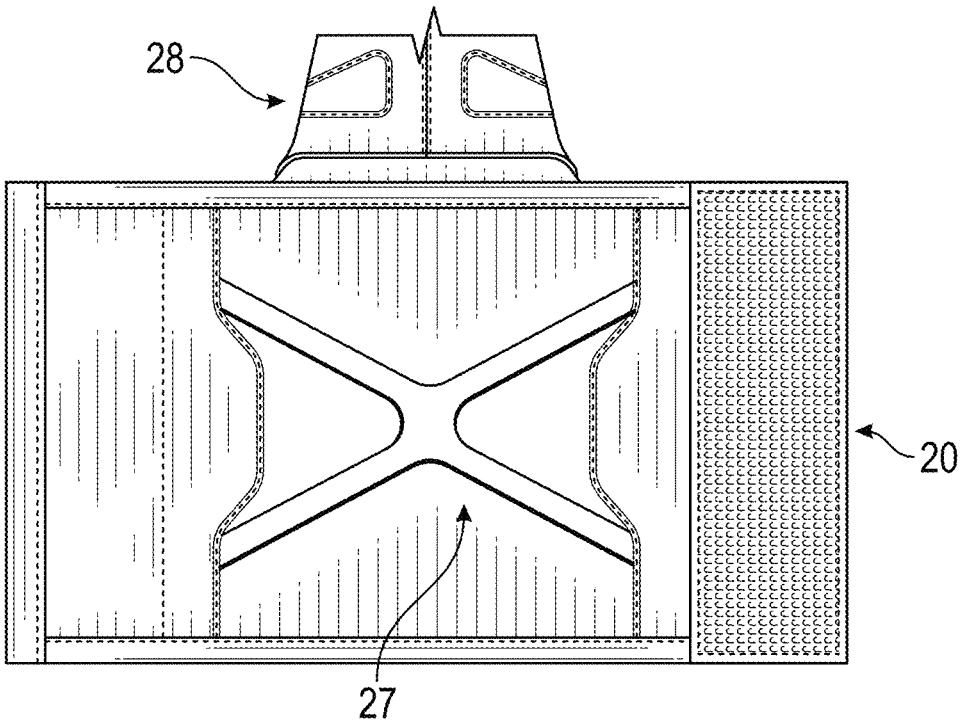
FIG. 9 is rear view of the pod holder of FIG. 8.

FIGS. 8-9 show the holster 20 in the unfolded or extended position. Ends (e.g., a left end and a right end) 22, 24 of the holster 20 can couple to each other to define a channel into which at least a portion of a pod of paintballs can be inserted. The ends 22, 24 of the holster 20 can attach to each other via one or more fasteners 21 (see FIGS. 10, 11), such as hoop-and-loop fasteners, such as VELCRO®. A pouch 28 is attached to an end of the holster 20. The pouch 28 can receive at least a portion (e.g., an end portion) of the pod of paintballs when the holster 20 is in the enclosed position that defines the channel that receives the pod.

Figure 10:
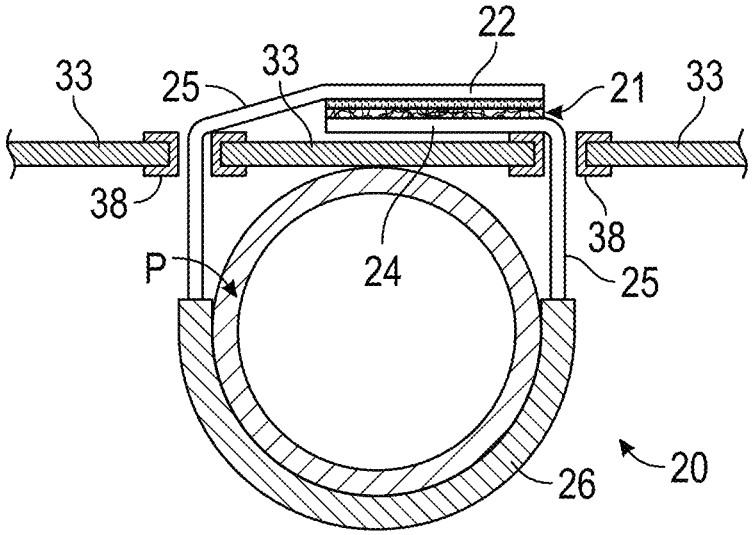
FIG. 10 is a schematic cross-sectional view of the pod holder attached to the paintball pod harness of FIG. 1.
Figure 11:
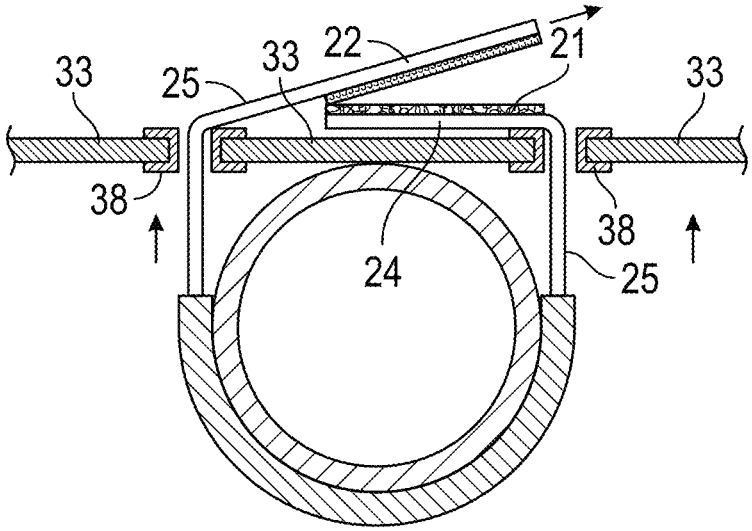
FIG. 11 is a schematic cross-sectional view of the pod holder partially attached to the paintball pod harness of FIG. 1.

With reference to FIGS. 10-11, the ends 22, 24 of the holster 20 can be inserted through the openings or slots 38 in the wall 33 of the back plate 30 and attached to each other via the fasteners 21 (e.g., hoop-and-loop fasteners, or VELCRO®). The holster 20 defines a chamber that at least partially receives a pod P of paintballs therein. Advantageously, the connection between the ends 22, 24 of the holster 20 can be adjusted (e.g., by detaching the flap 34 from the rear surface of the back plate 30 and) by detaching the ends 22, 24 from each other and reattaching them at a different location of each other (e.g., reattached with different overlap between the hoop-and-loop fasteners), to thereby adjust a tension of the holster 20 on the pod P. Advantageously, the user can therefore adjust the force applied by the holster 20 on the pod P (e.g., to provide a relatively looser or snug fit of the holster 20 on the pod P) and adjust the ease with which the pod P can be removed from the holster 20. Therefore, the holster 20 can advantageously be adjusted in tension to securely hold the pod P of paintballs. As there can be multiple holsters 20 attached to the back plate 30, this feature advantageously allows the user to individually adjust the tension of each holster 20 on the harness 100.

Figure 12:
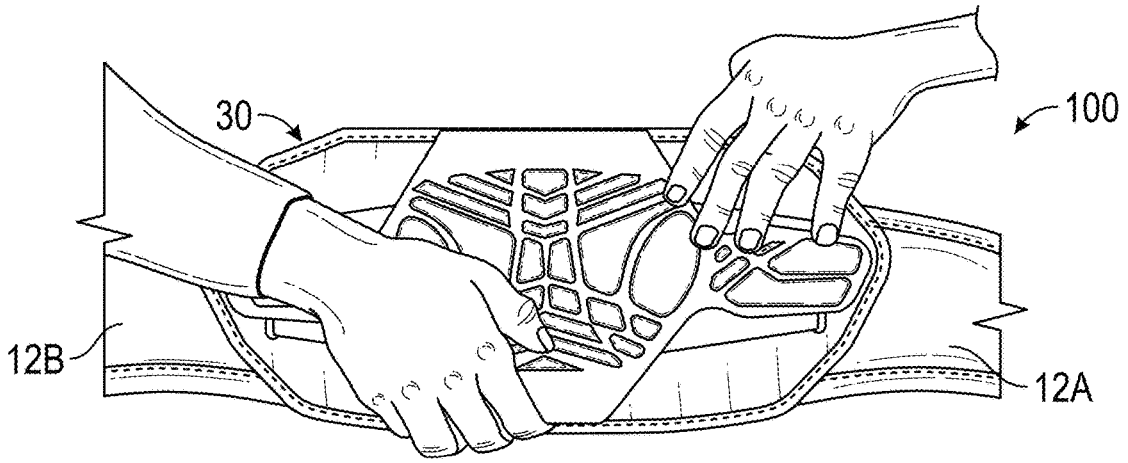
FIG. 12 is a partial rear view of the paintball pod harness of FIG. 1 in an assembled state.
Figure 13:
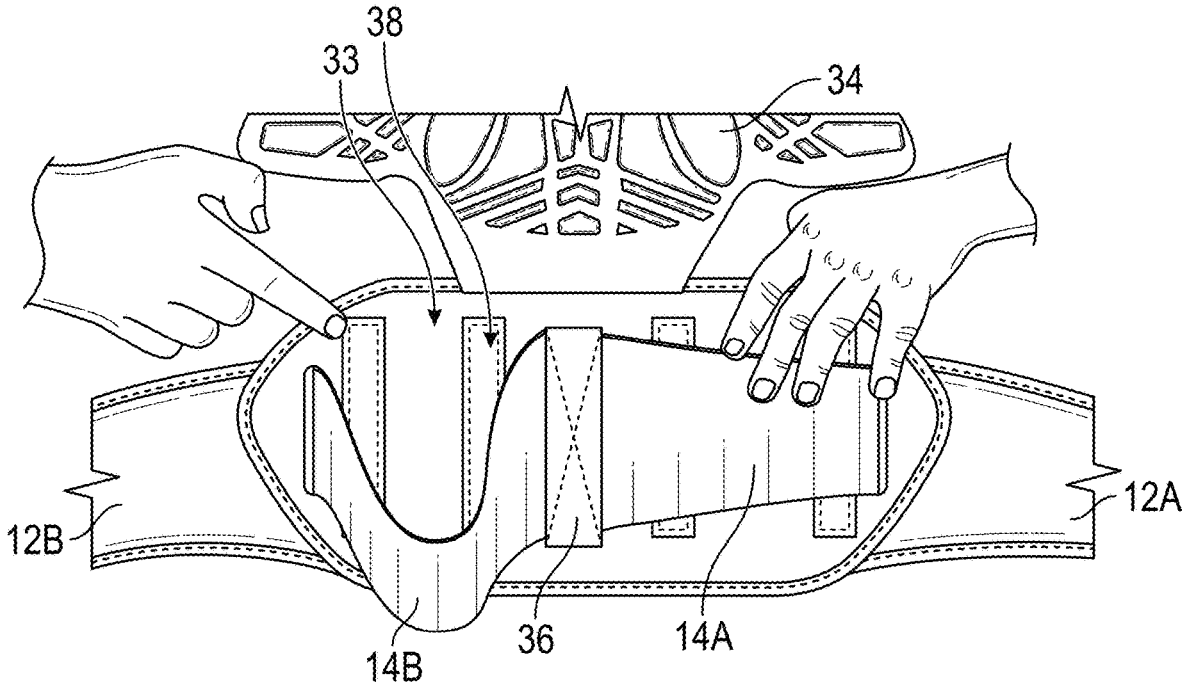
FIG. 13 is a partial rear view of the paintball pod harness of FIG. 1 in a partially disassembled state.
Figure 14:
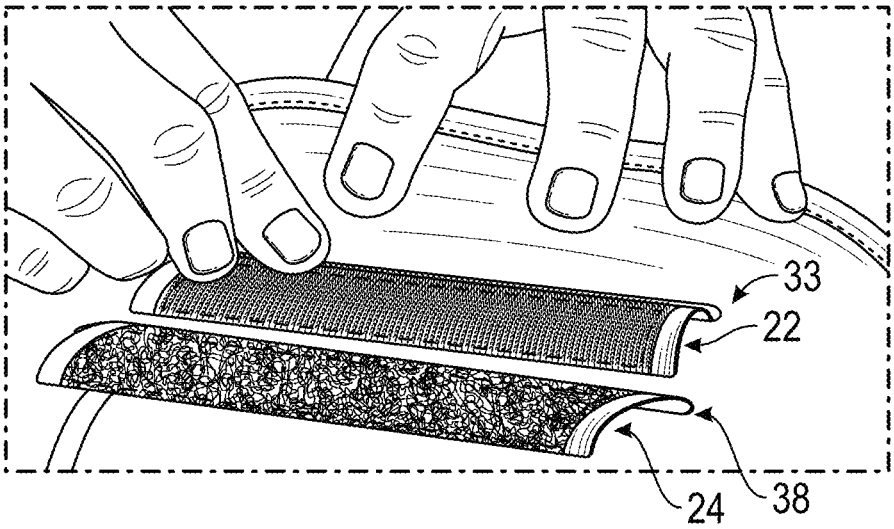
FIG. 14 is a partial view of a pod holder partially attached to the paintball pod harness of FIG. 1.
Figure 15:
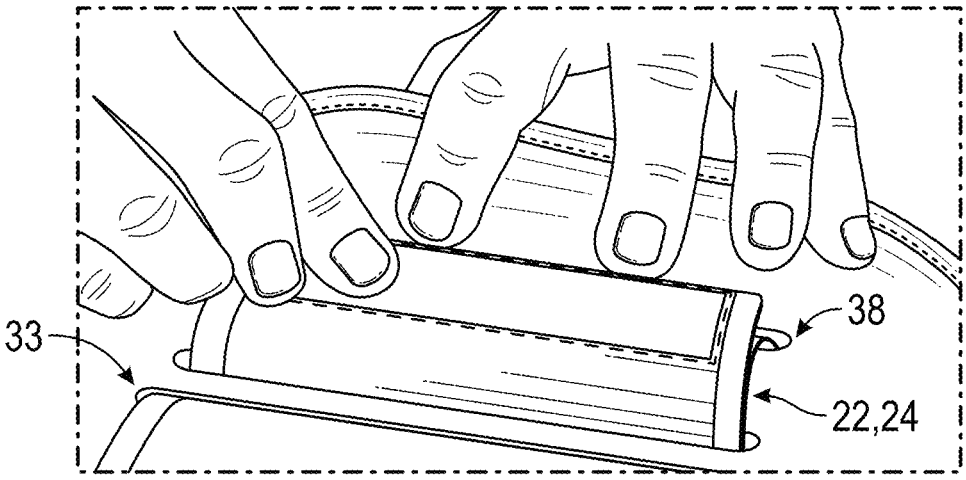
FIG. 15 is a partial view of the pod holder attached to the paintball pod harness of FIG. 1.

FIGS. 12-19 show the harness 100 in use. FIG. 12 shows a rear side of the back plate 30 with the flap 34 attached to the rear surface of the back plate 30. FIG. 13 shows the flap 34 detached from the rear surface of the back plate 30 to allow adjustments to the holsters 20 (e.g. to adjust a tension of the holsters 20 on the pods P of paintballs). FIGS. 14-15 show an adjustment of a holster 20 on the harness 100. FIG. 14 shows the rear surface of the wall 33 with the ends 22, 24 of the holster 20 extending through the slots 38 in the wall 33 and detached from each other, and FIG. 15 shows the ends 22, 24 reattached to each other on the rear surface of the wall 33.

Figure 16:
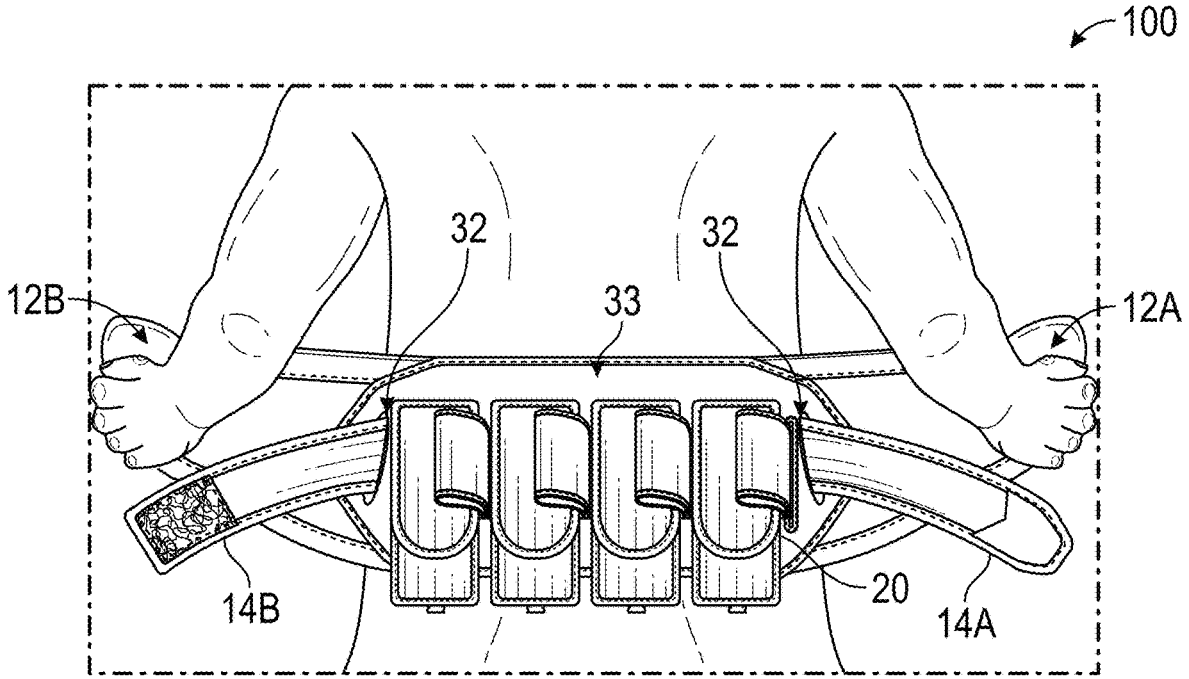
FIG. 16 is a partial front view of the paintball pod harness during use.
Figure 17:
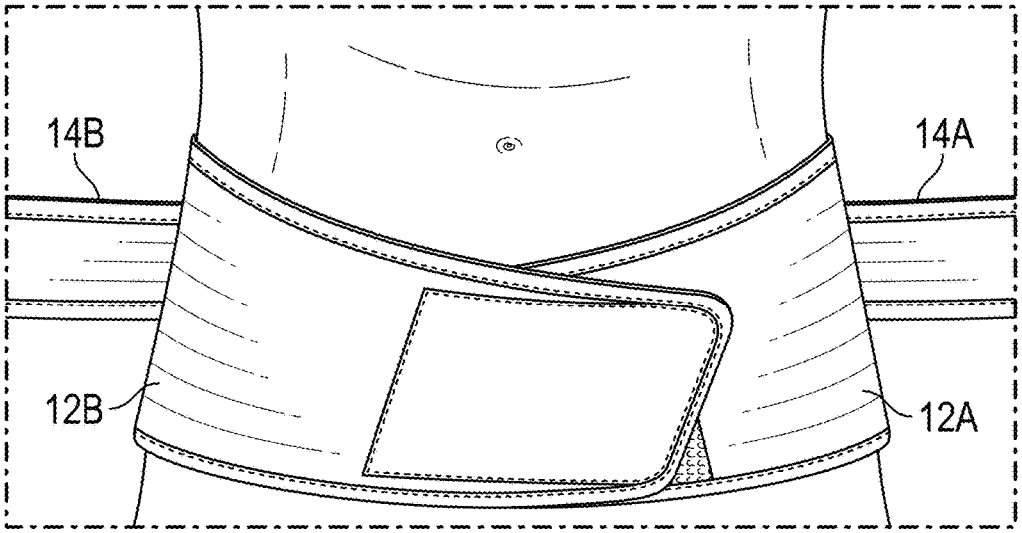
FIG. 17 is a partial view of main straps of the paintball pod harness of FIG. 1 attached to each other.
Figure 18:
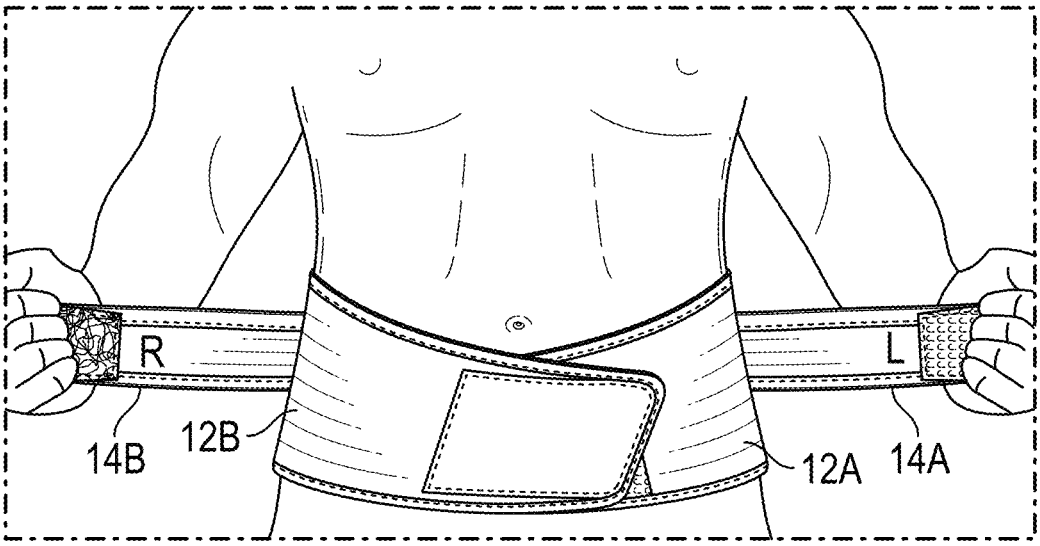
FIG. 18 is a partial view of the main straps of the paintball pod harness of FIG. 1 attached to each other, and secondary straps of the paintball pod harness in an extended state.
Figure 19:
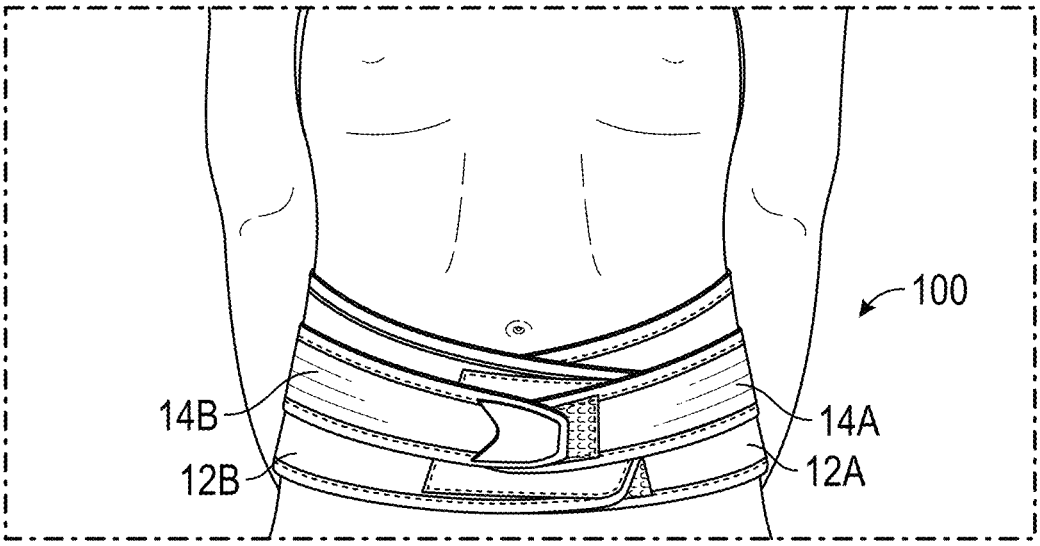
FIG. 19 is a partial view of the main straps of the paintball pod harness of FIG. 1 attached to each other, and the secondary straps attached to the main straps.

FIGS. 16-19 show the coupling of the harness 100 on the user's body. FIG. 16 shows the user holding onto the primary straps 12A, 12B with the wall 33 back plate 30 placed generally against the user's waist or lower back. The secondary straps 14A, 14B can optionally be detached from the primary straps 12A, 12B. FIG. 17 shows the primary straps 12A, 12B attached to each other on a front side of the user's waist, the secondary straps 14A, 14B optionally detached from the primary straps 12A, 12B. FIG. 18 shows the user holding the secondary straps 14A, 14B. Optionally, the user can stretch (e.g., pull on) the secondary straps 14A, 14B to bring the back plate 30 closer to the user's lower back. FIG. 19 shows the secondary straps 14A, 14B attached to the primary straps 12A, 12B (optionally in the stretched position). In one implementation, the secondary straps 14A, 14B can additionally or alternatively attach to each other (e.g., with fasteners, such as hoop-and-loop fasteners, such as VELCRO®).

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A paintball pod harness, comprising:

a support plate having a rear surface configured to face a user's lower back when the harness is worn by the user;

a pair of primary straps extending from opposite ends of the support plate and configured to extend about the user's waist and removably couple to each other when the harness is worn by the user;

a pair of secondary straps attached to the rear surface of the support plate and configured to extend through a pair of openings in the support plate, at least a portion of the pair of secondary straps being elastic, the pair of secondary straps configured to releasably couple to a front surface of the pair of primary straps; and a plurality of holsters attached to the support plate, the holsters defining a channel configured to resiliently receive at least a portion of a pod of paintballs therein, wherein the pair of secondary straps are configured to be stretched while detached from the pair of primary straps to adjust a tension of the harness on the user and configured to be coupled to said pair of primary straps in the stretched position, wherein increasing the stretching of the secondary straps is configured to further pull the support plate against the user's back when the harness is worn by the user.

2. The paintball pod harness of claim 1, wherein at least a portion of the primary straps is elastic.

3. The paintball pod harness of claim 1, wherein at least one of the plurality of holsters is detachable from the support plate.

4. The paintball pod harness of claim 3, wherein said at least one of the plurality of holsters includes a stabilizing plate, a first elastic material portion attached to a left side of the stabilizing plate, a second elastic material portion attached to a right side of the stabilizing plate, and fasteners attached to the first and second elastic material portions to thereby allow the first and second material portions to couple to each other via the fasteners to define the channel configured to receive at least a portion of the pod of paintballs therein.

5. The paintball pod harness of claim 4, further comprising a backing attached to the stabilizing plate.

6. The paintball pod harness of claim 5, wherein the backing comprises an anti-slip feature or material configured to engage a surface of the pod of paintballs when inserted in the channel.

7. The paintball pod harness of claim 4, wherein the fasteners are hoop-and-loop fasteners.

8. The paintball pod harness of claim 4, wherein at least a portion of the first and second elastic material portions of said at least one of the plurality of holsters are configured to extend through slots in a wall of the support plate so that the fasteners attach to each other adjacent the rear surface of the support plate and the channel of the holster is defined at least partially by a front surface of the support plate.

9. The paintball pod harness of claim 8, wherein a tension provide said at least one of the plurality of holsters on the pod of paintballs is adjustable by detaching the first and second elastic material portions from each other and reattaching the first and second material portions to each other so that their fasteners overlap relative to each other by a different amount.

10. A paintball pod harness, comprising:

a support plate having a rear surface configured to face a user's lower back when the harness is worn by the user;

a pair of primary straps extending from opposite ends of the support plate and configured to extend about the user's waist and removably couple to each other when the harness is worn by the user;

a pair of secondary straps attached to the rear surface of the support plate and configured to extend through a pair of openings in the support plate, at least a portion of the pair of secondary straps being elastic, the pair of secondary straps configured to releasably couple to a front surface of the pair of primary straps; and a plurality of holsters removably attached to the support plate, the holsters defining a channel configured to resiliently receive at least a portion of a pod of paintballs therein, wherein the pair of secondary straps are configured to be stretched while detached from the pair of primary straps to adjust a tension of the harness on the user and configured to be coupled pair of primary straps in the stretched position, wherein increasing the stretching of the secondary straps is configured to further pull the support plate against the user's back when the harness is worn by the user.

11. The paintball pod harness of claim 10, wherein at least a portion of the primary straps is elastic.

12. The paintball pod harness of claim 10, wherein the holsters include a stabilizing plate, a first elastic material portion attached to a left side of the stabilizing plate, a second elastic material portion attached to a right side of the stabilizing plate, and fasteners attached to the first and second elastic material portions to thereby allow the first and second material portions to couple to each other via the fasteners to define the channel configured to receive at least a portion of the pod of paintballs therein.

13. The paintball pod harness of claim 12, further comprising a backing attached to the stabilizing plate.

14. The paintball pod harness of claim 13, wherein the backing comprises an anti-slip feature or material configured to engage a surface of the pod of paintballs when inserted in the channel.

15. The paintball pod harness of claim 12, wherein the fasteners are hoop-and-loop fasteners.

16. The paintball pod harness of claim 12 wherein at least a portion of the first and second elastic material portions are configured to extend through slots in a wall of the support plate so that the fasteners attach to each other adjacent the rear surface of the support plate and the channel of the holster is defined at least partially by a front surface of the support plate.

17. The paintball pod harness of claim 12, wherein a tension provided by each of the plurality of holsters is adjustable by detaching the first and second elastic material portions from each other and reattaching the first and second material portions to each other so that their fasteners overlap relative to each other by a different amount.

18. A paintball pod harness, comprising:

a support plate having a rear surface configured to face a user's lower back when the harness is worn by the user;

a pair of straps extending from opposite ends of the support plate and configured to extend about the user's waist and removably couple to each other when the harness is worn by the user; and a plurality of holsters removably attached to the support plate, the holsters defining a channel configured to resiliently receive at least a portion of a pod of paintballs therein, the plurality of holsters including a stabilizing plate, a first elastic material portion attached to a left side of the stabilizing plate, a second elastic material portion attached to a right side of the stabilizing plate, and hoop-and-loop fasteners attached to the first and second elastic material portions to thereby allow the first and second material portions to couple to each other via the fasteners to define the channel configured to receive at least a portion of the pod of paintballs therein, at least a portion of the first and second elastic material portions configured to extend through slots in a wall of the support plate so that the fasteners attach to each other adjacent the rear surface of the support plate and the channel of the holster is defined at least partially by a front surface of the support plate, wherein a tension provided by each of the plurality of holsters is adjustable by detaching the first and second elastic material portions from each other and reattaching the first and second material portions to each other so that their fasteners overlap relative to each other by a different amount.

19. The paintball pod harness of claim 18, further comprising a backing attached to the stabilizing plate, the backing comprising an anti-slip feature or material configured to engage a surface of the pod of paintballs when inserted in the channel.

* * * * *